US007301321B1

(12) United States Patent
Uang et al.

(10) Patent No.: US 7,301,321 B1
(45) Date of Patent: Nov. 27, 2007

(54) VOLTAGE REFERENCE CIRCUIT

(75) Inventors: Uei-Shan Uang, Taichung County (TW); Kuen-Shan Chang, Hsinchu (TW); Mei-Show Chen, Hsinchu (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 0 days.

(21) Appl. No.: 11/470,499

(22) Filed: Sep. 6, 2006

(51) Int. Cl.
*G05F 3/16* (2006.01)

(52) U.S. Cl. ..... 323/313; 323/316; 323/907

(58) Field of Classification Search ..... 323/312, 323/313, 314, 315, 316, 317, 907
See application file for complete search history.

(56) References Cited

U.S. PATENT DOCUMENTS 6,563,295 B2 * 5/2003 Juang ..... 323/315
6,906,581 B2 * 6/2005 Kang et al. ..... 323/313
6,958,597 B1 * 10/2005 Lin et al. ..... 323/313

OTHER PUBLICATIONS

Jointly authored by Nissinen, et al. , Article title "A Low Voltage CMOS Constant Current-Voltage Reference Circuit" IEEE International Symposium on Circuits and System(ISCAS 2004), Vancouver, Canada, May 23-26, 2004, vol. I, pp. 318-384.

Jointly authored by Hu, et al., Article title "A 900 mV 25 FW High PSRR CMOS Voltage Reference Dedicated to Implantable Micro-Devices" IEEE-ISCAS 2003, Thailand, pp. 373-376, no month.

Jointly authored by T. Ytterdal, Article title "CMOS bandgap voltage reference circuit for supply voltages down to 0.6 V" IEE Electronic Letters, vol. 39, No. 20, pp. 1427-1428, Oct. 2, 2003.

* cited by examiner

*Primary Examiner*—Jessica Han
(74) *Attorney, Agent, or Firm*—Winston Hsu

(57) ABSTRACT

A voltage reference circuit including a positive temperature coefficient current generator, a negative temperature coefficient current generator, and a first resistor is provided. In the positive temperature coefficient current generator, two transistors are operated in the weak inversion region, and a second resistor is connected in series between the gates of the two transistors. The second resistor employs the characteristic that a transistor operated in weak inversion region acts like a bipolar junction transistor to generate a positive temperature coefficient current. The negative temperature coefficient current generator generates a negative temperature coefficient current in response to a negative temperature coefficient voltage drop on a third resistor. The positive temperature coefficient current and the negative temperature coefficient current flow through the first resistor together, thus producing a stable reference voltage.

23 Claims, 7 Drawing Sheets

VOLTAGE REFERENCE CIRCUIT

BACKGROUND OF THE INVENTION

1. Field of Invention

The present invention relates to a voltage reference circuit. More particularly, the present invention relates to a voltage reference circuit of a CMOS transistor.

2. Description of Related Art

FIG. 1 is a curve diagram of the relevant parameters of the semiconductor process technique. Supply voltage is scaling down because of reducing oxcide thickness. The threshold voltage ($V_{TH}$) of MOS transistor, however, is not scale down as much as the supply voltage ($V_{DD}$). Therefore, in the case that the voltage headroom is limited, all the analog circuits face the problem of maintaining their inherent capabilities under low operating voltage $V_{DD}$.

FIG. 2 is a circuit diagram of a conventional voltage reference circuit. The PMOS transistors MP21 and MP22 biased in the sub-threshold region are adopted to successfully obtain larger voltage headroom, such that the circuit can operate under lower operating voltage $V_{DD}$. The conventional voltage reference circuit includes a current mirror having PMOS transistors MP24~MP26, PMOS transistors MP21~MP23, an operation amplifier 201, and resistors R21, R22. For convenience of illustration, node voltages $V_{21}$ and $V_{22}$ are indicated. Then, the operating principle and the disadvantages of the conventional voltage reference circuit are illustrated with reference to FIG. 2.

As seen from the node voltages $V_{21}$ and $V_{22}$ of FIG. 2, by using the feedback mechanism formed by the operation amplifier 201 and the PMOS transistors MP24, MP25, the node voltage $V_{21}$ is equal to the node voltage $V_{22}$. Therefore, with the simple analysis of the circuit, the current $I_{21}$ flowing through the resistor $R_{21}$ is derived as follows.

$$I_{21}=(V_{SG21}-V_{SG22})/R_{21} \tag{1}$$

Herein, the current $I_{21}$ is replicated to the resistor $R_{22}$ through the current mirror, and the output reference voltage $V_{BG}$ is obtained as follows.

$$V_{BG}=V_{SG23}+R_{22}/R_{21}*(V_{SG21}-V_{SG22}) \tag{2}$$

Since the PMOS transistors MP21, MP22 are biased in the subthreshold region in an area ratio of 1: K, by using the fact that current characteristics of the PMOS transistors, so they can be analyzed as bipolar transistors analysis, the reference voltage $V_{BG}$ is further expressed as $$V_{BG} = V_{SG23} + \frac{R_{22}}{R_{21}} \cdot n \cdot V_T \cdot \ln(K) \tag{3}$$

where n is a process parameter, and $V_T$ is a thermal voltage. As seen from the formula (3), the conventional voltage reference circuit generates the temperature-independent reference voltage $V_{BG}$ by using the combination of the negative temperature coefficient voltage $V_{SG23}$ and the positive temperature coefficient voltage $V_T$.

Along with the changes of the circuit architecture, in order to allow the PMOS transistors MP21, MP 22 operate in the subthreshold region, the resistor R21 that is used by the conventional voltage reference circuit has a larger resistance value, and the current mirrors M24~M26 may operate in the subthreshold region arises. Furthermore, the conventional voltage reference circuit outputs the reference voltage $V_{BG}$, wherein the negative temperature coefficient voltage $V_{SG23}$ is related to the negative temperature coefficient. Since the temperature coefficient of the current flowing through the PMOS transistor MP23 is in proportion to the absolute temperature, and additionally two input voltages (i.e. node voltages $V_{21}$, $V_{22}$) of the operation amplifier 201 are very small so that operation amplifier 201 may not operate at the low-gain region the present invention employs the resistors, R31 and R32 in FIG. 3, to increase the input common mode voltage of the operation amplifier, which will let opamp 311 operate at the higher gain region.

SUMMARY OF THE INVENTION

Accordingly, the object of the present invention is to provide a voltage reference circuit, which provides a stable reference voltage with low temperature dependence when operating under a low operating voltage.

In order to achieve the above and other objects, the present invention provides a voltage reference circuit. A positive temperature coefficient current generator is used to generate a positive temperature coefficient current. A negative temperature coefficient current generator is used to generate a negative temperature coefficient current. The positive temperature coefficient current and the negative temperature coefficient current flow through a first resistor to generate a temperature-independent current, such that a stable reference voltage is output from the first resistor. The positive temperature coefficient current generator includes a second resistor, a first PMOS transistor, a second PMOS transistor, a positive temperature coefficient current mirror, a first operation amplifier, a third resistor, a fourth resistor, a fifth resistor, and a sixth resistor. The first PMOS transistor and the second PMOS transistor are biased in a weak inversion region, and thus the second resistor connected in series between the gates of the two transistors generates a positive temperature coefficient current by using the current characteristic of the first and second PMOS transistors being similar to that of the bipolar junction transistor. The positive temperature coefficient current mirror employs a negative feedback mechanism formed by the first operation amplifier to produce the bias current required by the first PMOS transistor and the second PMOS transistor. And the third resistor and the fourth resistor provide another current path to the ground, so as to ensure that the positive temperature coefficient current mirror is kept in the strong inversion region. Two input voltages of the first operation amplifier rise up to the common mode input range of the first operation amplifier by the voltage drop of the fifth resistor and the sixth resistor.

The negative temperature coefficient current generator includes a negative temperature coefficient current mirror, a second operation amplifier, a seventh resistor, a third PMOS transistor, and a temperature-independent current source. The temperature-independent current source provides a bias current to the third PMOS transistor, so as to make the gate-source voltage of the third PMOS transistor being a voltage only related to the negative temperature coefficient. A negative temperature coefficient current is generated in response to the negative temperature coefficient voltage (the gate-source voltage of the third PMOS transistor) drop on the seventh resistor by the virtual short property in the two input ends of the second operation amplifier.

Therefore, in the voltage reference circuit of the present invention, the positive temperature coefficient current and the negative temperature coefficient current are gathered to form a current with low temperature dependence. The current with low temperature dependence flows through the first resistor, thus producing a stable reference voltage. Compared with the conventional architecture, by changing the coupling manner of the second resistor, the positive temperature coefficient current generator makes the circuit operate at a low voltage, and the cost of the layout area of the circuit is also saved.

In order to the make aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

DESCRIPTION OF EMBODIMENTS

Figure 2:
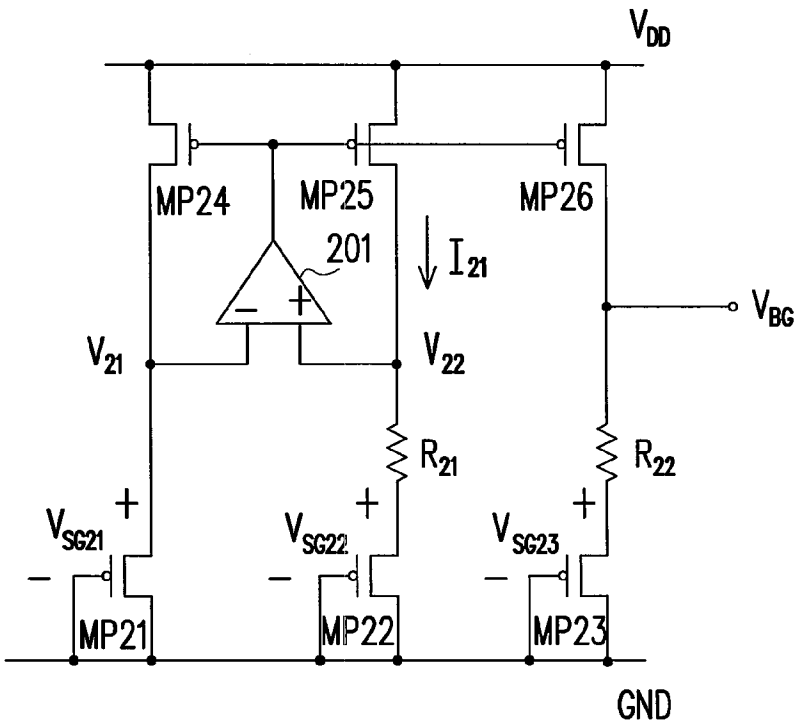
FIG. 2 is a circuit diagram of the conventional voltage reference circuit.
Figure 1:
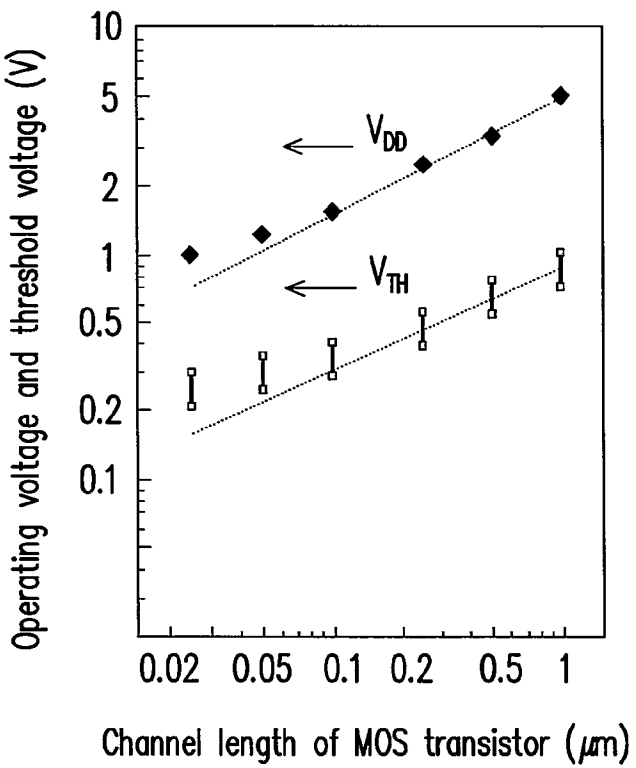
FIG. 1 is a curve diagram of the relevant parameters of the semiconductor process technique.
Figure 3:
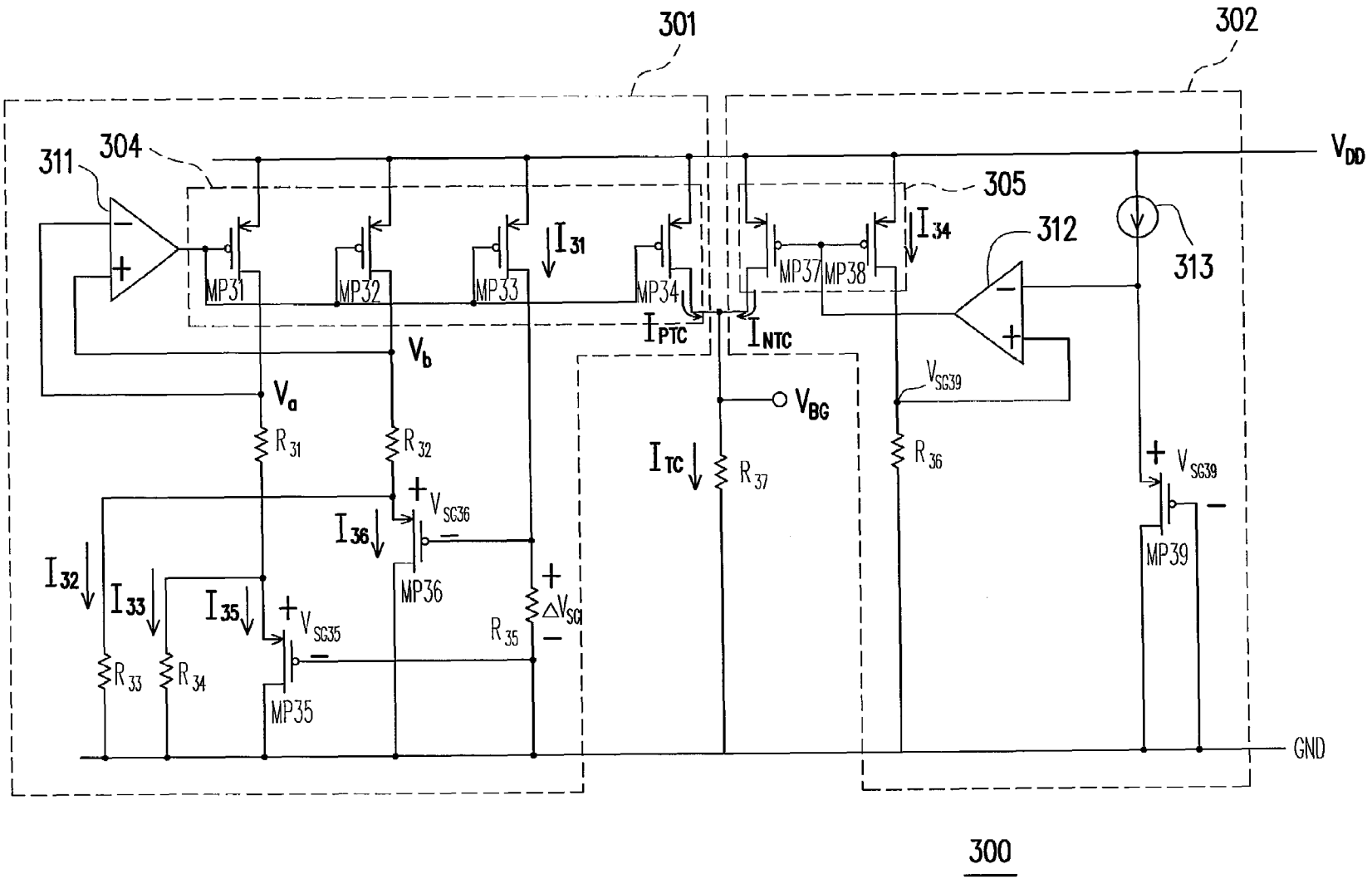
FIG. 3 is a circuit diagram of the voltage reference circuit according to an embodiment of the present invention.

FIG. 3 shows a voltage reference circuit according to an embodiment of the present invention. The voltage reference circuit comprises a positive temperature coefficient current generator 301, a negative temperature coefficient current generator 302, and a resistor R37. The positive temperature coefficient generator 301 is used to generate a positive temperature coefficient current $I_{PTC}$, and the negative temperature coefficient current generator 302 is used to generate a negative temperature coefficient current $I_{NTC}$. Then, two currents $I_{PTC}$ and $I_{NTC}$ flow into R37 to form a temperature-independent current $I_{TC}$. The current $I_{TC}$ flows through the resistor R37 to form a stable reference voltage $V_{BG}$ with low temperature dependence.

The positive temperature coefficient current generator 301 comprises an operation amplifier 311, a positive temperature coefficient current mirror 304 having PMOS transistors MP31~MP34, PMOS transistors MP35, MP36, and resistors R31~R34. Two input ends of the operation amplifier 311 are connected to the nodes of Va and Vb respectively, and the output end thereof is electrically connected to the gates of the PMOS transistors MP31~MP34. The PMOS transistor MP31 has a source connected to the operating voltage $V_{DD}$, a drain connected to the resistor R31, and a gate connected to the output of the operation amplifier 311. The PMOS transistor MP32 has a source connected to the operating voltage $V_{DD}$, a drain connected to the resistor R32, and a gate connected to the output of the operation amplifier 311. The PMOS transistor MP33 has a source coupled to the operating voltage $V_{DD}$, a drain connected to the resistor R35, and a gate connected to the output of the operation amplifier 311. The PMOS transistor MP34 has a source connected to the operating voltage $V_{DD}$, a drain connected to the resistor R37, and a gate connected to the output of the operation amplifier 311. The resistor R31 is connected in series between the drains of the PMOS transistors MP31, MP35, and the resistor R32 is connected in series between the drains of the PMOS transistors MP32, MP36. Two resistors R31 and R32 are connected to the ground end respectively by another two resistors R33 and R34. Two ends of the resistor R35 are respectively connected to the gates of PMOS transistors MP35, MP36. For convenience of illustration, the node voltages Va and Vb are indicated herein.

The positive coefficient current generator 301 makes the node voltage Va equal to the node voltage Vb by using the feedback mechanism formed by the operation amplifier 311 and the PMOS transistors MP31, MP32. In this manner, the voltage difference $\Delta V_{SG}$ drop on the resistor R35 is derived and expressed as follows.

$$\Delta V_{SG}=V_{SG35}-V_{SG36} \tag{4}$$

The corresponding current I31 flowing through the resistor R35 is expressed as follows.

$$I31=(V_{SG35}=V_{SG36})/R35 \tag{5}$$

In order to make the present voltage reference circuit operating under the low operating voltage $V_{DD}$, the PMOS transistors MP35, MP36 of the present embodiment operate in the subthreshold region in an area ratio of 1:K. Under the circumstance that the current characteristic of the two transistors MP35, MP36 are similar to that of the bipolar junction transistor, the voltages $V_{SG35}$ and $V_{SG36}$ are expressed by the following formulas:

$$V_{SG35} \approx V_{TH} + n \cdot V_T \cdot \ln\left(\frac{I_{D35}}{(W/L)_{35} \cdot I_{DO}}\right) \tag{6}$$

$$V_{SG36} \approx V_{TH} + n \cdot V_T \cdot \ln\left(\frac{I_{D36}}{(W/L)_{36} \cdot I_{DO}}\right) \tag{7}$$

where, $V_{TH}$ is a threshold voltage; n and $I_{DO}$ are process parameters; $V_T$ is a thermal voltage; $I_D$ is a drain current flowing through the MOS transistor; $(W/L)_{35}$ is a width to length ratio of the PMOS transistor MP35; and $(W/L)_{36}$ is a width to length ratio of the PMOS transistor MP36. With formulas (4)~(7), the current I31 flowing through the resistor R35 is derived as follows.

$$I31 = \frac{1}{R35} \cdot n \cdot V_T \cdot \ln(K) \tag{8}$$

Since the thermal voltage $V_T$ is a positive temperature coefficient, the current $I_{PTC}$ formed by replicating the current I31 is a positive temperature coefficient current. In other words, the positive temperature coefficient current mirror 304 generates a positive temperature coefficient current $I_{PTC}$.

In order to prevent the positive temperature coefficient current mirror 304 from operating in the subthreshold region, the positive temperature coefficient current generator 301 employs the resistors R33 and R34 to form another current path for the positive temperature coefficient current mirror 304, such that the positive temperature coefficient current mirror 304 is kept in the strong inversion region by the branch currents I32 and I33. Furthermore, two input ends of the operation amplifier 311 are respectively connected to the PMOS transistors MP35, MP36 by the resistors R31, R32. The voltage drops on the resistors R31, R32 contribute to raising the two input voltages (i.e. node voltages Va and Vb) of the operation amplifier 311, such that the operation amplifier 311 is operated at the high-gain region and not limited by the input common mode range of the operation amplifier 311.

In the voltage reference circuit according to the present embodiment, the negative temperature coefficient current generator 302 comprises an operation amplifier 312, a quasi-temperature-independent current source 313, a negative temperature coefficient current mirror 305 having PMOS transistors MP37, MP38, a PMOS transistor MP39, and a resistor R36. Two input ends of the operation amplifier 312 are connected to the ground respectively by the diode-connected PMOS transistor MP39 and the resistor R36, and the output end thereof is connected to the gates of the PMOS transistors MP37, MP38. The quasi-temperature-independent current source 313 is connected in series between the operating voltage $V_{DD}$ and the PMOS transistor MP39. The gate and the drain of the PMOS transistor MP39 are connected to the ground end, and the source thereof is connected to the quasi-temperature-independent current source 313. The coupling relation of the negative temperature coefficient current mirror 305 is described as follows. The PMOS transistor MP37 has a source connected to the operating voltage $V_{DD}$, a gate connected to the output end of the operation amplifier 312, and a drain connected to the resistor R37. The PMOS transistor MP38 has a source connected to the operating voltage $V_{DD}$, a gate connected to the output end of the operation amplifier 312, and a drain connected to the resistor R36.

In order to provide a negative temperature coefficient current, the negative temperature coefficient current generator 302 employs a quasi-temperature-independent current source 313 to provide a bias current for the PMOS transistor MP39, so as to generate a voltage $V_{SG39}$ related to the negative temperature coefficient. By using the virtual short property in the two input ends of the operation amplifier 312, a current I34 with a current strength of $V_{SG39}$/R36 is generated in response to the voltage $V_{SG39}$ drop on the resistor R36. Then, the current I34 is replicated by the negative temperature coefficient current mirror 305, such that the negative temperature coefficient current generator 302 generates a negative temperature coefficient current $I_{NTC}$.

Figure 4:
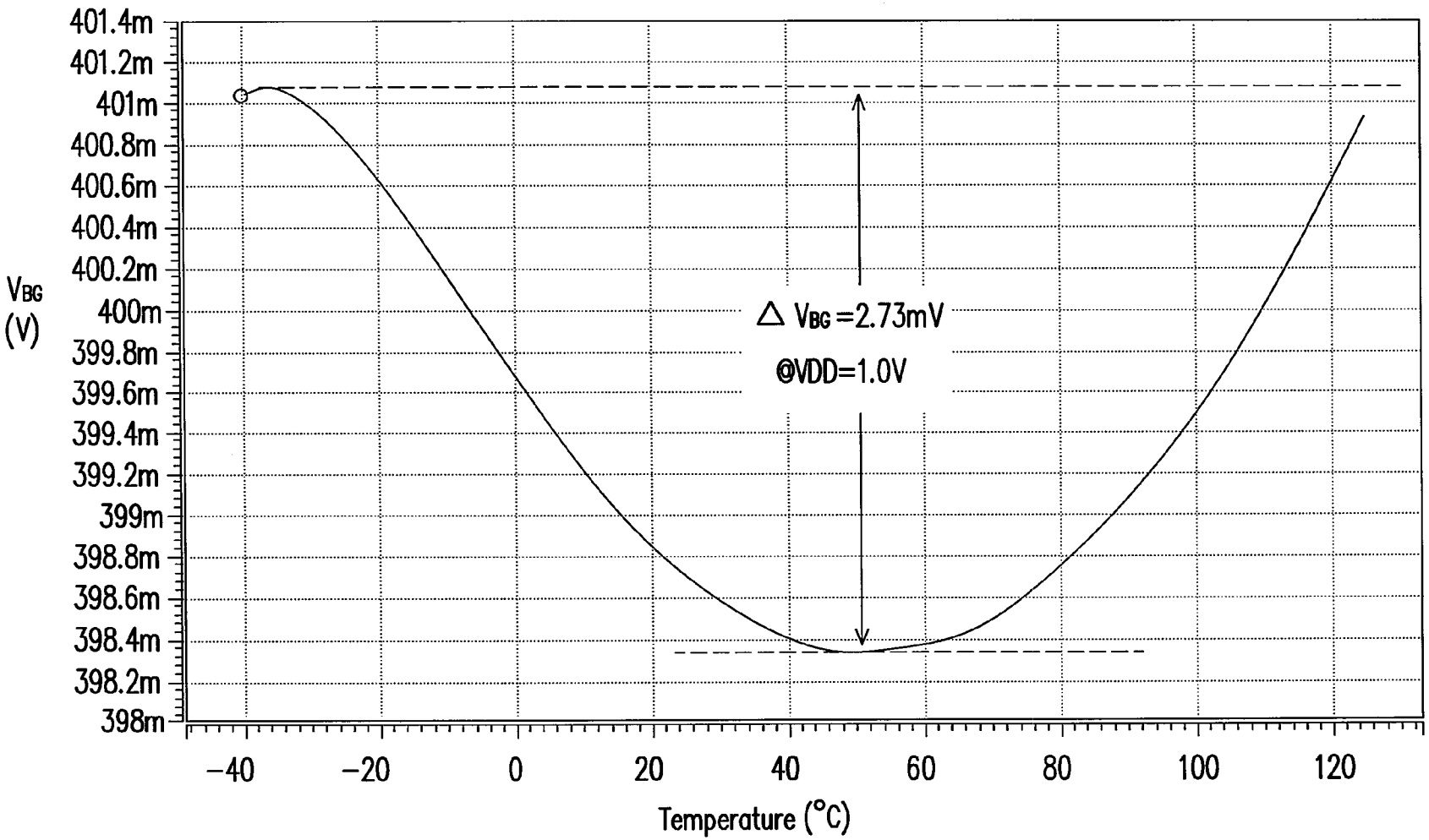
FIG. 4-FIG. 8 are curve diagrams of the circuit characteristic of the voltage reference circuit of the present embodiment.
Figure 5:
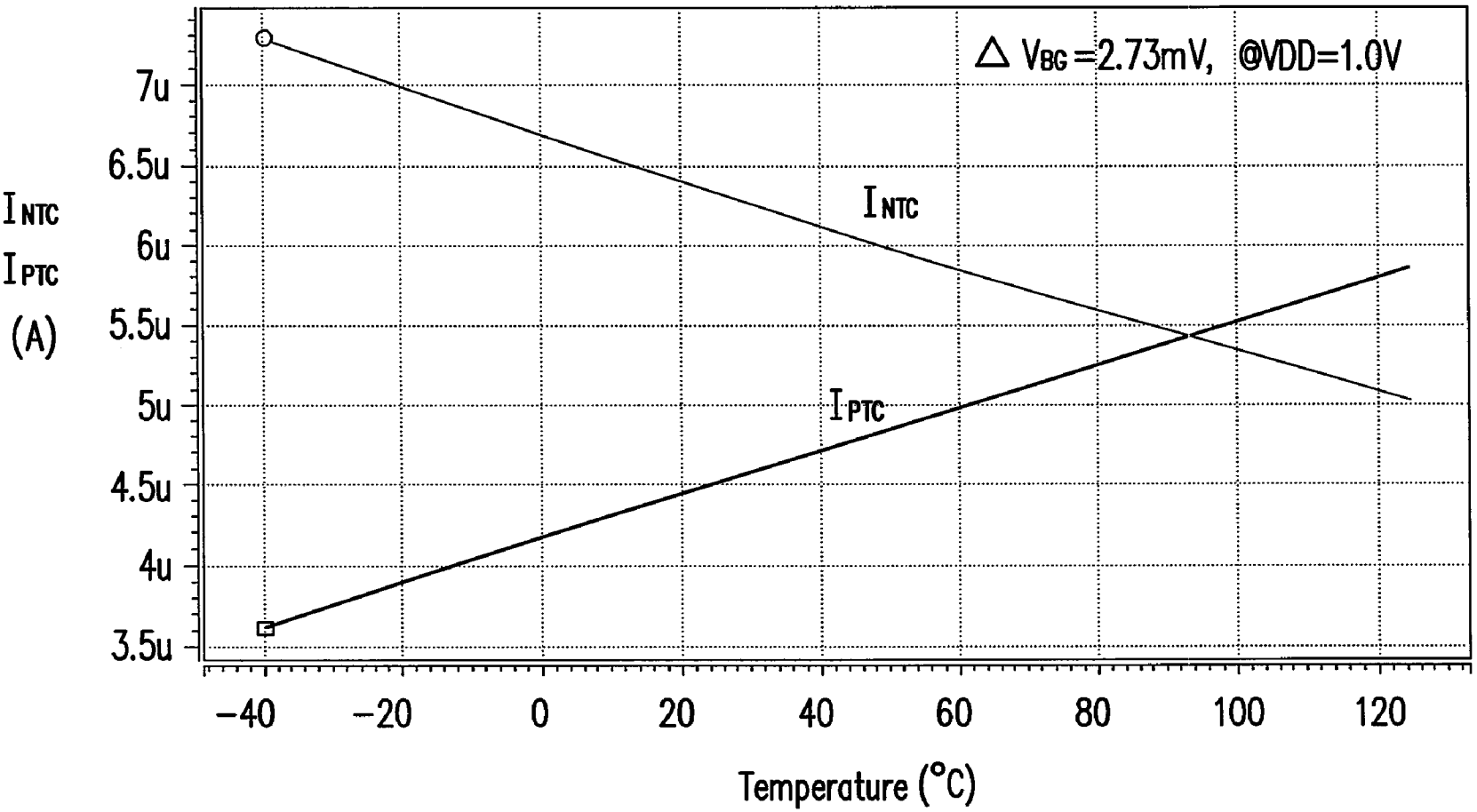
Figure 6:
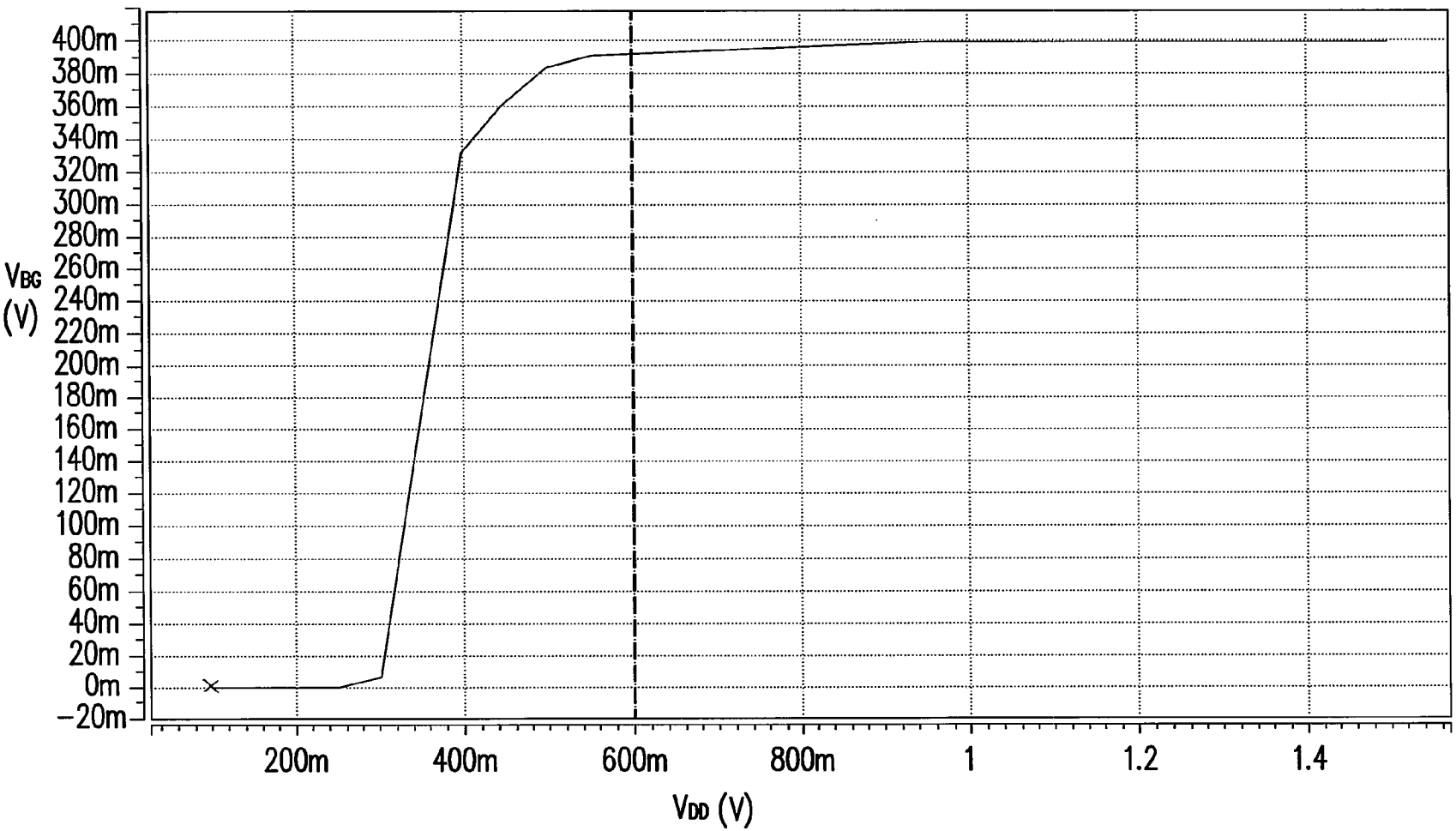
Figure 7:
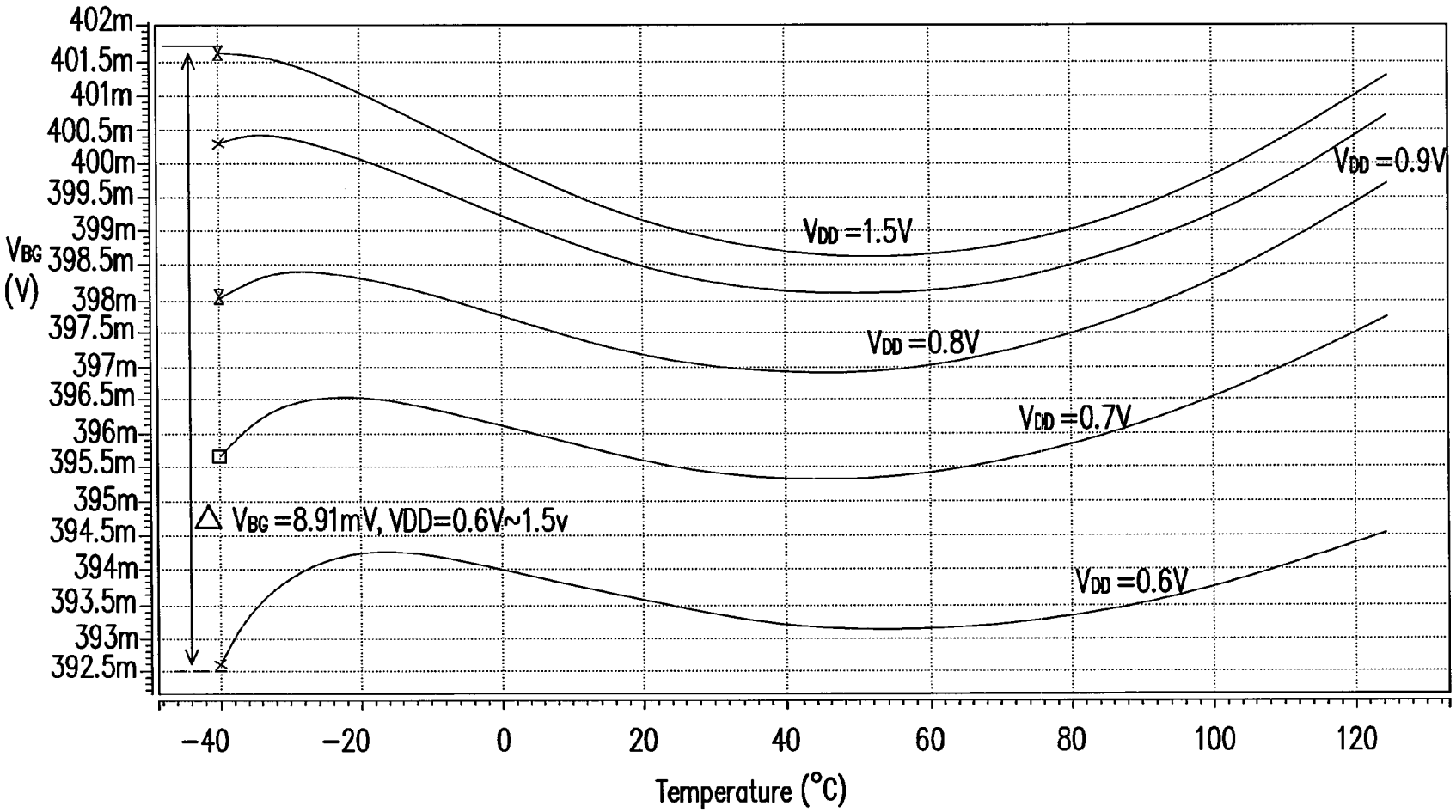
Figure 8:
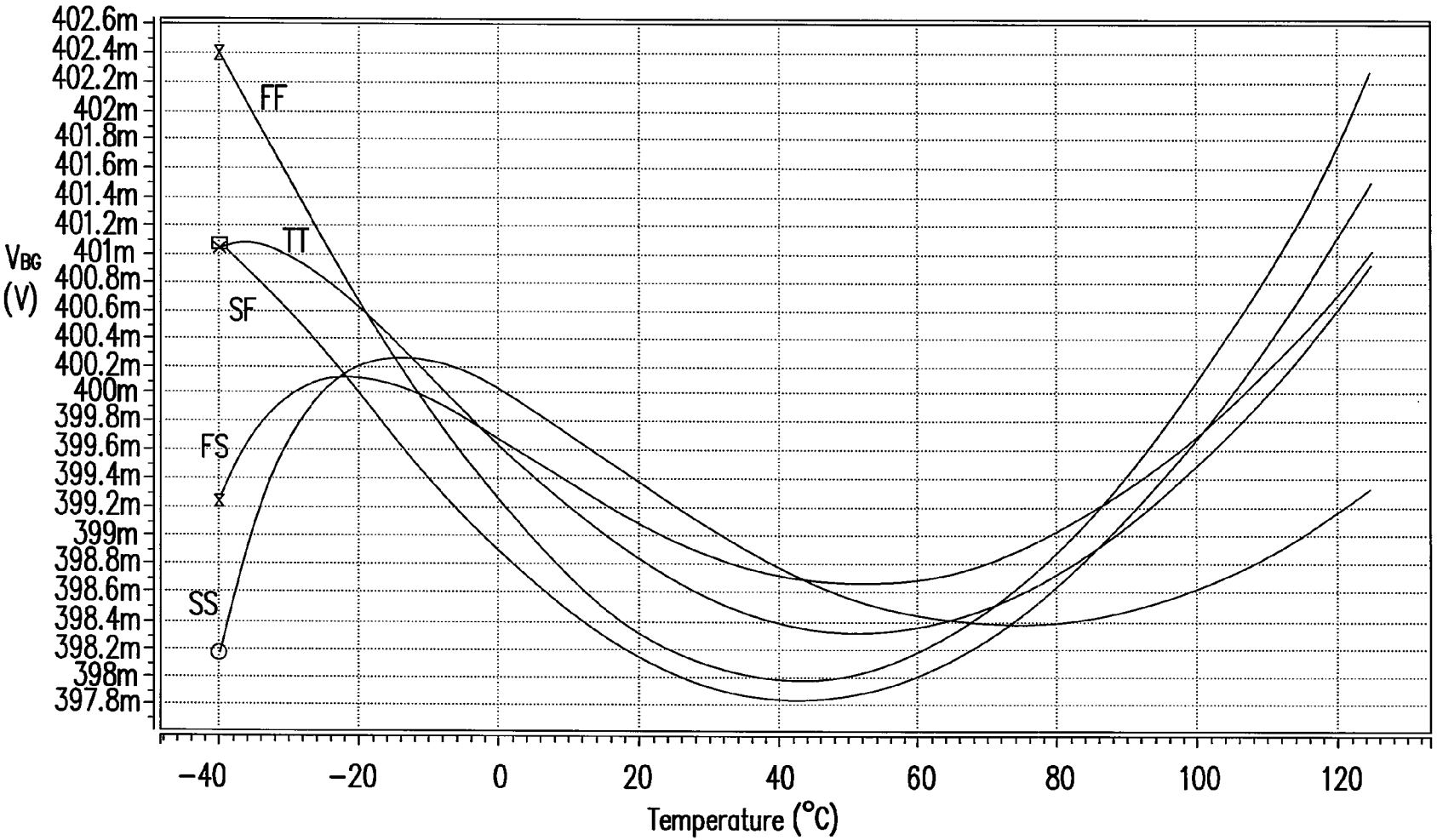

In order to further make the voltage reference circuit of the embodiment more comprehensible, FIG. 4~FIG. 8 show the circuit characteristics of the present embodiment, which are respectively illustrated below. FIG. 4 shows that when the operating voltage $V_{DD}$ is 1 V, in the present embodiment, during the temperature changing from −40° C. to 125° C., the reference voltage variance $\Delta V_{BG}$ of the output reference voltage $V_{BG}$ is 2.73 mV (i.e. 16.55 ppm/° C.). FIG. 5 shows the relation between the positive temperature coefficient current $I_{PTC}$ and the negative temperature coefficient current $I_{NTC}$ when the operating voltage $V_{DD}$ is 1 V and the reference voltage variance $\Delta V_{BG}$ is 2.73 mV in the embodiment. FIG. 6 shows that under the normal operation, the voltage reference circuit of the embodiment allows a minimum operating voltage $V_{DD}$ of about 600 mV. Variations in reference voltage (VDD=0.6V~1.5V) with supply voltage and temperature is plotted in FIG. 7, the reference voltage variance $\Delta V_{BG}$ resulting from different operating voltages $V_{DD}$ is 8.91 mV at the worst case. Finally, FIG. 8 shows the changes of the reference voltage $V_{BG}$ in the voltage reference circuit of the embodiment, when the process parameters changes, i.e. under different corner model (FF, TT, SF, FS, SS). The present invention took process variation into account.

To sum up, the embodiment of the present invention employs the positive temperature coefficient generator and the negative temperature coefficient generator to generate a stable reference voltage with low temperature dependence. Compared with the conventional architecture, the present invention employs the circuit architecture that the coupling mariner of the resistors can be changed to allow the circuit operating under lower operating voltage, and thus the layout area of the circuit and the limitation to the operation amplifier caused by the circuit are reduced and circumvented. Compared with the conventional art, the resistance of the resistor R35 is greatly reduced, so the circuit area of the embodiment can be further reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage reference circuit, comprising:

a positive temperature coefficient current mirror for producing a positive temperature coefficient current;

a negative temperature coefficient current mirror connected to the positive temperature coefficient current mirror for producing a negative temperature coefficient current;

a first resistor, the positive temperature coefficient current flowing through the first resistor;

a first transistor connected to the positive temperature coefficient current mirror and the first resistor;

a second transistor connected to the positive temperature coefficient current mirror, the first resistor, and the first transistor; and a second resistor connected to the positive temperature coefficient current mirror and the negative temperature coefficient current mirror, wherein the positive temperature coefficient current and the negative temperature coefficient current flow through the second resistor and then the second resistor generates a reference voltage.

2. The voltage reference circuit as claimed in claim 1, wherein the positive temperature coefficient current mirror comprises:

a third transistor having a third source connected to a power source end, a third gate, and a third drain;

a fourth transistor having a fourth source connected to the power source end, a fourth gate connected to the third gate of the third transistor, and a fourth drain;

a fifth transistor having a fifth source connected to the power source end, a fifth gate connected to the third gate of the third transistor, and a fifth drain connected to the first resistor; and a sixth transistor having a sixth source connected to the power source end, a sixth gate connected to the third gate of the third transistor, and a sixth drain connected to the second resistor.

3. The voltage reference circuit as claimed in claim 2, wherein the negative temperature coefficient current mirror comprises:

a seventh transistor having a seventh source connected to the power source end, a seventh gate, and a seventh drain connected to the sixth drain of the sixth transistor; and an eighth transistor having an eighth source connected to the power source end, a eighth gate connected to the seventh gate of the seventh transistor, and an eighth drain.

4. The voltage reference circuit as claimed in claim 3, further comprising a first operation amplifier having a first positive input end connected to the fourth drain of the fourth transistor, a first negative input end connected to the third drain of the third transistor, and a first output end connected to the third, fourth, fifth, and sixth gates of the third, fourth, fifth, and sixth transistors, wherein the voltage of the first positive input end is the same as that of the first negative input end.

5. The voltage reference circuit as claimed in claim 4, wherein the first transistor comprises a first source, a first gate connected to the first resistor, and a first drain connected to the ground.

6. The voltage reference circuit as claimed in claim 5, wherein the second transistor comprises a second source, a second gate connected to the first resistor, and a second drain connected to the ground, wherein the first resistor is connected between the first gate of the first transistor and the second gate of the second transistor.

7. The voltage reference circuit as claimed in claim 6, further comprising:

a third resistor coupled between the third drain of the third transistor and the first source of the first transistor; and a fourth resistor coupled between the fourth drain of the fourth transistor and the second source of the second transistor.

8. The voltage reference circuit as claimed in claim 6, further comprising:

a fifth resistor connected between the first source of the first transistor and the ground end; and a sixth resistor coupled between the second source of the second transistor and the ground end.

9. The voltage reference circuit as claimed in claim 6, further comprising a seventh resistor coupled between the eighth drain of the eighth transistor and the ground end, and the negative temperature coefficient current flows through the seventh resistor.

10. The voltage reference circuit as claimed in claim 9, further comprising a temperature-independent current source coupled to the power source for producing a temperature-independent current.

11. The voltage reference circuit as claimed in claim 10, further comprising a ninth transistor having a ninth source coupled to the temperature-independent current source, a ninth gate connected to the ground, and a ninth drain connected to the ground, wherein a gate-source voltage of the ninth transistor is a negative temperature coefficient voltage.

12. The voltage reference circuit as claimed in claim 11, further comprising a second operation amplifier having a second positive input end connected to the eighth drain of the eighth transistor, a second negative input end connected to the temperature-independent current source, and a second output end connected to the seventh gate of the seventh transistor and the eighth gate of the eighth transistor, wherein the voltage of the second positive input end is the negative temperature coefficient voltage.

13. A voltage reference circuit, comprising:

a positive temperature coefficient current mirror for producing a positive temperature coefficient current;

a negative temperature coefficient current mirror, connected to the positive temperature coefficient current mirror, used to generate a negative temperature coefficient current;

a temperature-independent current source for generating a temperature-independent current;

a first resistor, the positive temperature coefficient current flowing through the first resistor;

a first transistor coupled to the positive temperature coefficient current mirror and the first resistor;

a second transistor connected to the positive temperature coefficient current mirror, the first resistor, and the first transistor;

a third transistor connected to the temperature-independent current source for generating a negative temperature coefficient voltage; and a second resistor connected to the positive temperature coefficient current mirror and the negative temperature coefficient current mirror, wherein the positive temperature coefficient current and the negative temperature coefficient current flow through the second resistor, and then the second resistor outputs a reference voltage;

wherein the negative temperature coefficient current mirror generates the negative temperature coefficient current in response to the negative temperature coefficient voltage of the third transistor.

14. The voltage reference circuit as claimed in claim 13, wherein the positive temperature coefficient current mirror comprises:

a fourth transistor having a fourth source connected to a power source end, a fourth gate, and a fourth drain;

a fifth transistor having a fifth source connected to the power source end, a fifth gate connected to the fourth gate of the fourth transistor, and a fifth drain;

a sixth transistor having a sixth source connected to the power source end, a sixth gate connected to the fourth gate of the fourth transistor, and a sixth drain connected to the first resistor; and a seventh transistor having a seventh source connected to the power source end, a seventh gate connected to the fourth gate of the fourth transistor, and a seventh drain connected to the second resistor.

15. The voltage reference circuit as claimed in claim 14, wherein the negative temperature coefficient current mirror comprises:

an eighth transistor having an eighth source connected to the power source end, an eighth gate, and an eighth drain connected to the seventh drain of the seventh transistor; and a ninth transistor having a ninth source connected to the power source end, a ninth gate connected to the eighth gate of the eighth transistor, and a ninth drain.

16. The voltage reference circuit as claimed in claim 15, further comprising a first operation amplifier having a first positive input end connected to the fifth drain of the fifth transistor, a first negative input end connected to the fourth drain of the fourth transistor, and a first output end connected to the fourth, fifth, sixth, and seventh gates of the fourth, fifth, sixth, and seventh transistors, wherein the voltage of the first positive input end is the same as that of the first negative input end.

17. The voltage reference circuit as claimed in claim 16, wherein the first transistor comprises a first source, a first gate coupled to the first resistor, and a first drain connected to the ground.

18. The voltage reference circuit as claimed in claim 17, wherein the second transistor comprises a second source, a second gate connected to the first resistor, and a second drain connected to the ground, wherein the first resistor is connected between the first gate of the first transistor and the second gate of the second transistor.

19. The voltage reference circuit as claimed in claim 18, wherein the third transistor has a third source connected to the temperature-independent current source, and a third gate, and a third drain connected to the ground, a gate-source voltage of the third transistor is a negative temperature coefficient voltage.

20. The voltage reference circuit as claimed in claim 19, further comprising:

a third resistor coupled between the fourth drain of the fourth transistor and the first source of the first transistor; and a fourth resistor connected between the fifth drain of the fifth transistor and the second source of the second transistor.

21. The voltage reference circuit as claimed in claim 20, further comprising:

a fifth resistor coupled between the first source of the first transistor and the ground end; and a sixth resistor connected between the second source of the second transistor and the ground end.

22. The voltage reference circuit as claimed in claim 21, further comprising a seventh resistor connected between the ninth drain of the ninth transistor and the ground end, and the negative temperature coefficient current flows through the seventh resistor.

23. The voltage reference circuit as claimed in claim 22, further comprising a second operation amplifier having a second positive input end connected to the ninth drain of the ninth transistor, a second negative input end connected to the temperature-independent current source, and a second output end connected to the eighth gate of the eighth transistor and the ninth gate of the ninth transistor, wherein the voltage of the second positive input end is the negative temperature coefficient voltage.

* * * * *